US010483662B2

(12) United States Patent
Yamaguchi

(10) Patent No.: US 10,483,662 B2
(45) Date of Patent: Nov. 19, 2019

(54) CONNECTOR WITH L-SHAPED COAXIAL TERMINALS AND METHOD OF MANUFACTURE THEREOF

(71) Applicant: Hirose Electric Co., Ltd., Shinagawa-ku, Tokyo (JP)

(72) Inventor: Masahiko Yamaguchi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 16/276,467

(22) Filed: Feb. 14, 2019

(65) Prior Publication Data

US 2019/0305445 A1 Oct. 3, 2019

(30) Foreign Application Priority Data

Apr. 2, 2018 (JP) ..... 2018-070854

(51) Int. Cl.
*H01R 24/38* (2011.01)
*H01R 9/05* (2006.01)
(Continued)

(52) U.S. Cl.
CPC ..... *H01R 9/0518* (2013.01); *H01R 13/42* (2013.01); *H01R 13/506* (2013.01); *H01R 13/6585* (2013.01); *H01R 24/38* (2013.01); *H01R 9/05* (2013.01); *H01R 12/724* (2013.01); *H01R 13/501* (2013.01); *H01R 13/567* (2013.01);
(Continued)

(58) Field of Classification Search
CPC .... H01R 24/545; H01R 24/54; H01R 13/501; H01R 13/567; H01R 9/05; H01R 24/38; H01R 9/032; H01R 9/0518; H01R 12/724; H01R 13/6593; H01R 13/6592; H01R 13/6581; H01R 13/648; Y10S 439/902
USPC ..... 439/582, 902, 694, 466, 607.47, 607.48, 439/607.41, 881, 855
See application file for complete search history.

(56) References Cited

U.S. PATENT DOCUMENTS

2008/0026639 A1* 1/2008 Sardi ..... H01M 2/20 439/607.41
2015/0244115 A1* 8/2015 Yamaguchi ..... H01R 13/6581 439/580

FOREIGN PATENT DOCUMENTS

JP 2014-107139 A 6/2014
JP 2014107139 A * 6/2014

* cited by examiner

*Primary Examiner* — Abdullah A Riyami
*Assistant Examiner* — Justin M Kratt
(74) *Attorney, Agent, or Firm* — Procopio, Cory, Hargreaves & Savitch LLP

(57) ABSTRACT

L-shaped coaxial terminals, shielding members shielding these coaxial terminals, and a housing with insulating material having L-shaped terminal holding portions that hold the coaxial terminals and shielding members; the external terminal of the coaxial terminals has a conductor mounting portion extending in a forward-rearward direction and a terminal connecting portion extending downwardly from the front end side of the conductor mounting portion; the shielding members cover a section in the external terminal extending from the bottom face of the front end portion of the conductor mounting portion to the rear face of the upper end portion of the terminal connecting portion, electrically connecting the conductor mounting portion to the terminal connecting portion, forming an electrical path in the external terminal that passes through an area extending from below the front end portion of the conductor mounting portion to the rear of the upper end portion of the terminal connecting portion.

6 Claims, 12 Drawing Sheets

(51) Int. Cl.

| | |
|---|---|
| ***H01R 13/506*** | (2006.01) |
| ***H01R 13/6585*** | (2011.01) |
| ***H01R 13/42*** | (2006.01) |
| *H01R 13/6592* | (2011.01) |
| *H01R 13/6581* | (2011.01) |
| *H01R 13/648* | (2006.01) |
| *H01R 24/54* | (2011.01) |
| *H01R 13/56* | (2006.01) |
| *H01R 13/50* | (2006.01) |
| *H01R 12/72* | (2011.01) |
| *H01R 13/6593* | (2011.01) |

(52) U.S. Cl.

CPC ..... *H01R 13/648* (2013.01); *H01R 13/6581* (2013.01); *H01R 13/6592* (2013.01); *H01R 13/6593* (2013.01); *H01R 24/54* (2013.01); *H01R 24/545* (2013.01); *Y10S 439/902* (2013.01)

CONNECTOR WITH L-SHAPED COAXIAL TERMINALS AND METHOD OF MANUFACTURE THEREOF

CROSS REFERENCE TO RELATED APPLICATIONS

This Paris Convention Patent Application claims benefit under 35 U.S.C. § 119 and claims priority to Japanese Patent Application No. JP 2018-070854, filed on Apr. 2, 2018, titled "CONNECTOR WITH L-SHAPED COAXIAL TERMINALS AND METHOD OF MANUFACTURE THEREOF", the content of which is incorporated herein in its entirety by reference for all purposes.

BACKGROUND

Technical Field

The present invention relates to a connector with L-shaped coaxial terminals for electrically connecting electrical and electronic devices and the like, and to a method of manufacture thereof.

Background Art

In information communication and other technical fields, connectors with coaxial terminals are used, for example, to connect a communication device or another electrical or electronic device to a coaxial cable in order to transmit radio-frequency signals. Such connectors include connectors provided with L-shaped coaxial terminals in which the sections for mounting coaxial cables and the sections connected to coaxial terminals in a counterpart connector are orthogonal to one another (see Patent Document 1 below).

PRIOR ART LITERATURE

Patent Documents

[Patent Document 1]

Japanese Patent Application Publication No. 2014-107139.

SUMMARY

Problems to be Solved

Incidentally, a coaxial cable has a coaxial structure comprising an inner conductor passing through its axial centerline and an outer conductor completely surrounding the outer periphery of the inner conductor through the medium of an insulator disposed therebetween. As a result of using this structure, a coaxial cable has shielding effects that minimize leakage of signals transmitted by the coaxial cable to the environment and mixing of exogenous noise with said signals.

The coaxial terminals of the connector, as a whole, have a coaxial structure comprising an internal terminal passing through its axial centerline and an external terminal surrounding the periphery of the internal terminal through the medium of an insulating member disposed therebetween. Since the external terminal has formed therein a barrel, or the like, used to apply pressure to the outer conductor of the coaxial cable, there are discontinuous sections. However, since in the case of rectilinear coaxial terminals the external terminal can be formed in a rectilinear tubular shape, the number of discontinuous sections can be reduced. Consequently, the outer periphery of the internal terminal can be almost completely surrounded by the external terminal and shielding effects close to those of the coaxial cable can be implemented.

By contrast, in the case of L-shaped coaxial terminals, the external terminal must be L-shaped. For this reason, a gap is formed on the inside of the curved section of the external terminal and, because of this gap, there is a risk that the shielding effects may be decreased in comparison with rectilinear coaxial terminals. That is to say, the external terminal is manufactured, for example, by punching a metal sheet to form a metal sheet piece in the form of an unfolded external terminal and then bending the metal sheet piece. For this reason, it is difficult to form a curved L-shaped external terminal while maintaining a perfect continuous tubular shape throughout its entire length. For example, in the case of the coaxial terminals described in the above-mentioned Patent Document 1, when the curved section of the external terminal has a structure in which its outer metal sheet piece is curved, the metal sheet piece on the inside of the curved section becomes discontinuous and a gap is formed in this section. If there is such a gap in the external terminal, there is a risk that the signals to be transmitted may leak through the above-mentioned gap and the shielding effects will be reduced if, for instance, the electric current value of the signals is increased.

The present invention was made by considering problems such as the ones described above and it is an object of the invention to provide a connector capable of exerting strong shielding effects even though its configuration includes L-shaped coaxial terminals, as well as a method of manufacture thereof.

Solution to the Problems

In order to solve the above-mentioned problems, the connector of the present invention is provided with L-shaped coaxial terminals having an internal terminal and an external terminal provided on the outer periphery of the internal terminal, shielding members, formed from an electrically conductive material, that shield the coaxial terminals, and a housing, formed from an insulating material, having provided therein L-shaped terminal holding portions that hold the coaxial terminals and shielding members, wherein: the external terminal has a conductor mounting portion that extends in a forward-rearward direction and is used to mount an outer conductor of a coaxial cable, and a terminal connecting portion that extends downwardly from the front end side of the conductor mounting portion and is used for connecting to an external terminal of a coaxial terminal in a counterpart connector; the shielding members cover a section in the external terminal extending from a bottom face of the front end portion of the conductor mounting portion to the rear face of the upper end portion of the terminal connecting portion and, additionally, electrically connect the conductor mounting portion to the terminal connecting portion, and form an electrical path in the external terminal that passes through an area extending from below the front end portion of the conductor mounting portion to the rear of the upper end portion of the terminal connecting portion.

Also, the connector of the present invention may be provided with four coaxial terminals, four shielding members that respectively shield the four coaxial terminals, and a coupling member, formed from an electrically conductive material, that respectively electrically connects the four shielding members, wherein: the housing has a first section extending in a forward-rearward direction and a second section extending downwardly from the front end side of the first section; in the housing, there are provided four terminal holding portions that respectively hold the four coaxial terminals and the four shielding members; in the housing, the four terminal holding portions are respectively disposed in a section extending from the left lower side of the first section to the left rear side of the second section, a section extending from the right lower side of the first section to the right rear side of the second section, a section extending from the left upper side of the first section to the left front side of the second section, and a section extending from the right upper side of the first section to the right front side of the second section; the four shielding members are respectively disposed in the curved portions of the four terminal holding portions; the coupling member is disposed in an area surrounded by the four shielding members respectively disposed in the curved portions of the four terminal holding portions; and the coupling member has a main body portion and four contact pieces that respectively extend from the main body portion to the four shielding members to be respectively brought in contact with the four shielding members.

Also, in the connector of the present invention, the main body portion may have a securing portion used to secure the coupling member to the housing, a section of each shielding member sandwiched between the contact pieces and the housing, and the coupling member is secured to the housing by the securing portion, as a result of which the shielding members are supported by the housing via the contact pieces.

Also, in a connector of the present invention, the shielding members may have a base portion that is disposed in an area in the external terminal extending from below the front end portion of the conductor mounting portion to the rear of the upper end portion of the terminal connecting portion and that covers a section in the external terminal extending from the bottom face of the front end portion of the conductor mounting portion to the rear face of the upper end portion of the terminal connecting portion, and extension portions that extend from the base portion to the front of the terminal connecting portion and apply pressure to the front face of the terminal connecting portion to thereby bring the rear face of the upper end portion of the terminal connecting portion in contact with the base portion.

In order to solve the above-mentioned problems, a method of connector manufacture of the present invention which is a method of manufacture of the connector of the present invention may comprise the steps of: disposing the shielding members in the curved portions of the terminal holding portions; and disposing the coaxial terminals inside the terminal holding portions where the shielding members are disposed.

Also, another method of connector manufacture of the present invention which is a method of manufacture of the connector of the present invention may comprise the steps of: disposing the four shielding members respectively in the curved portions of the four terminal holding portions in the housing; in the housing, disposing the coupling member in an area surrounded by the four shielding members respectively disposed in the curved portions of the four terminal holding portions and electrically connecting the four shielding members by bringing the four contact pieces respectively in contact with the four shielding members; and disposing the four coaxial terminals respectively inside the four terminal holding portions where the four shielding members electrically connected by the coupling member are disposed.

Technical Effect

It is an object of the present invention to enable strong shielding effects even in configurations provided with L-shaped coaxial terminals. In accordance with the present invention, strong shielding effects can be obtained even in configurations provided with L-shaped coaxial terminals.

An exploded perspective view of a connector according to an inventive embodiment.

FIG. 2

A bottom external view of the connector according to the inventive embodiment.

FIG. 3

Figure 2:
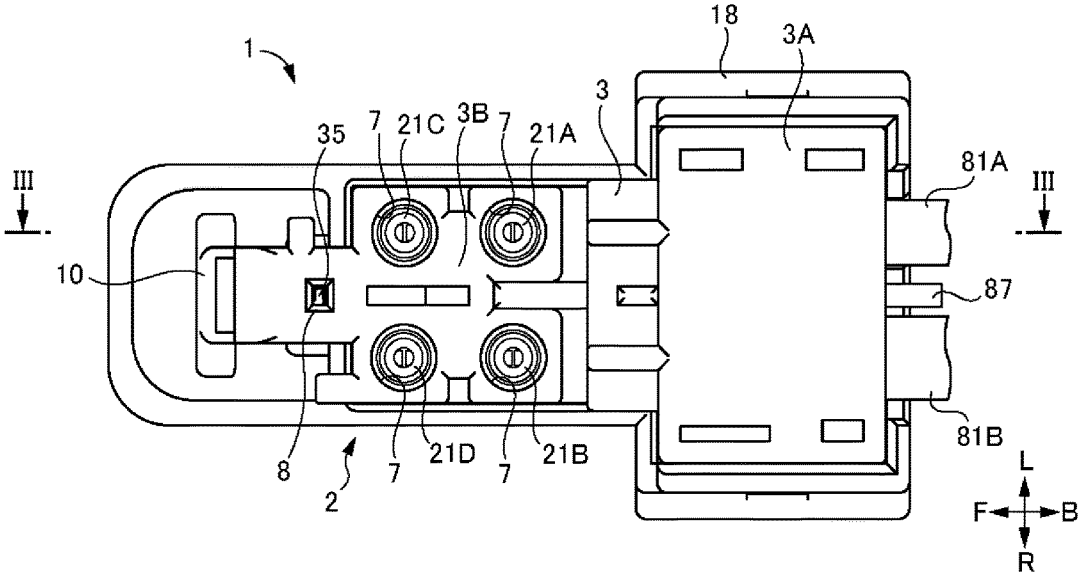

A cross-section of the connector shown in FIG. 2, as viewed in the direction of arrows III-III.

FIG. 4

A rear external view of the connector shown in FIG. 2.

FIG. 5

An external view illustrating a housing main body and a spacer used in the connector according to the inventive embodiment.

FIG. 6

An external view illustrating a first and third coaxial terminals used in the connector according to the inventive embodiment.

FIG. 7

Figure 6:
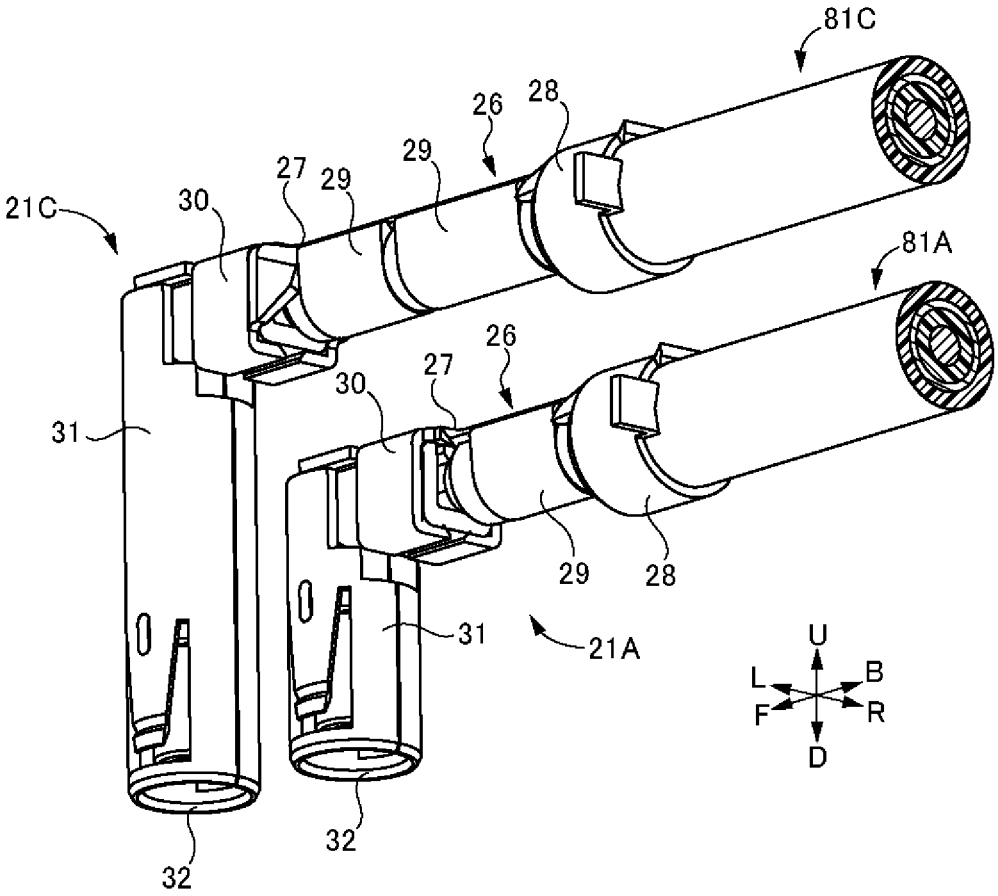

A cross-sectional view illustrating a cross-section of the two coaxial terminals shown in FIG. 6, taken along a longitudinal centerline dividing the terminals in two in the side-to-side direction.

FIG. 8

A top rear-left external view of a first shielding member used in the connector according to the inventive embodiment.

FIG. 9

Figure 8:
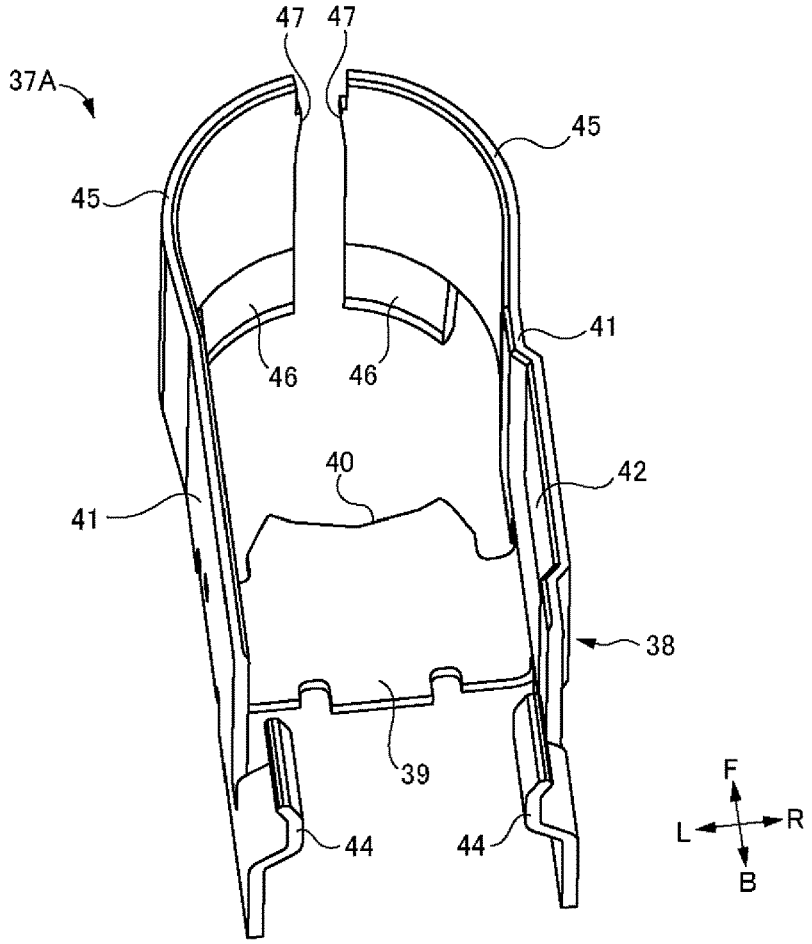

A bottom rear-left external view of the shielding member shown in FIG. 8.

FIG. 10

A top rear-left external view of a third shielding member used in the connector according to the inventive embodiment.

FIG. 11

Figure 10:
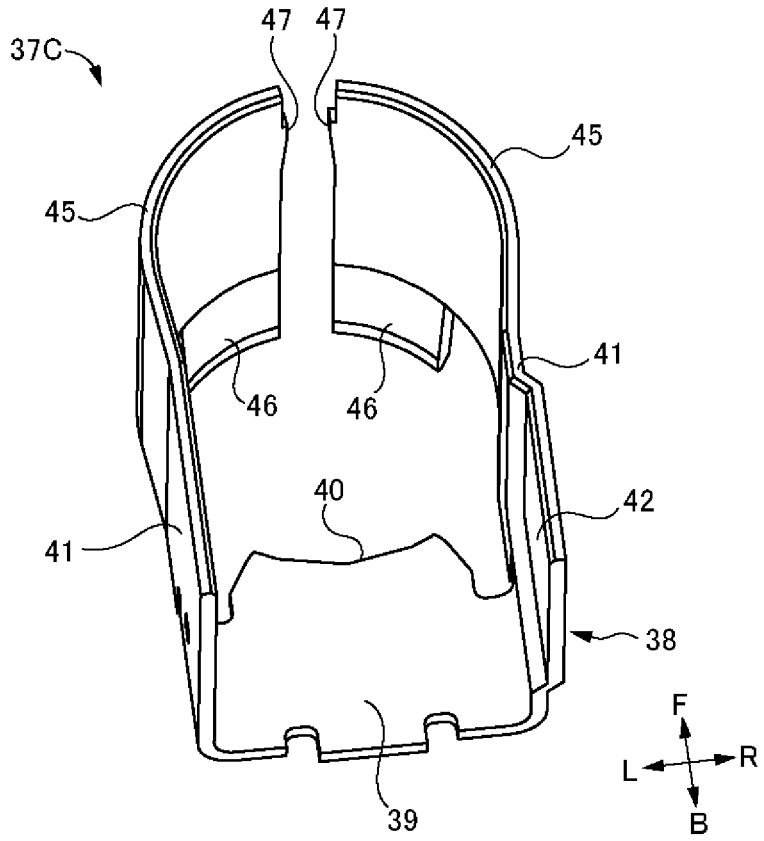

A bottom rear-left external view of the shielding member shown in FIG. 10.

FIG. 12

An illustration of the first and third coaxial terminals of the connector according to the inventive embodiment respectively shielded by the first and third shielding members.

FIG. 13

A top external view the four shielding members and the coupling member used in the connector according to the inventive embodiment.

FIG. 14

Figure 13:
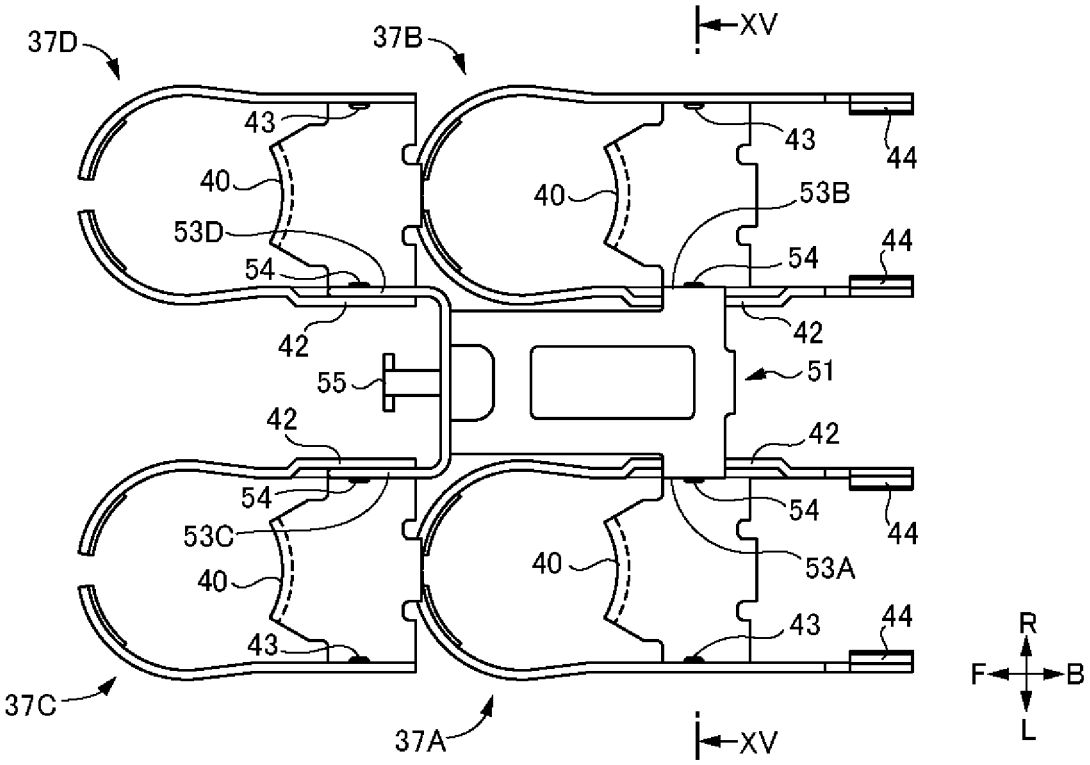

An external view of the first through fourth shielding members and the coupling member illustrated in FIG. 13, as viewed from the left.

FIG. 15

A cross-sectional view of the first and second shielding members and the coupling member illustrated in FIG. 13, as viewed in the direction of arrows XV-XV.

FIG. 16

An illustration of the coupling member used in the connector according to the inventive embodiment, as viewed, respectively, from above, from the left, and from the front.

FIG. 17

Figure 5:
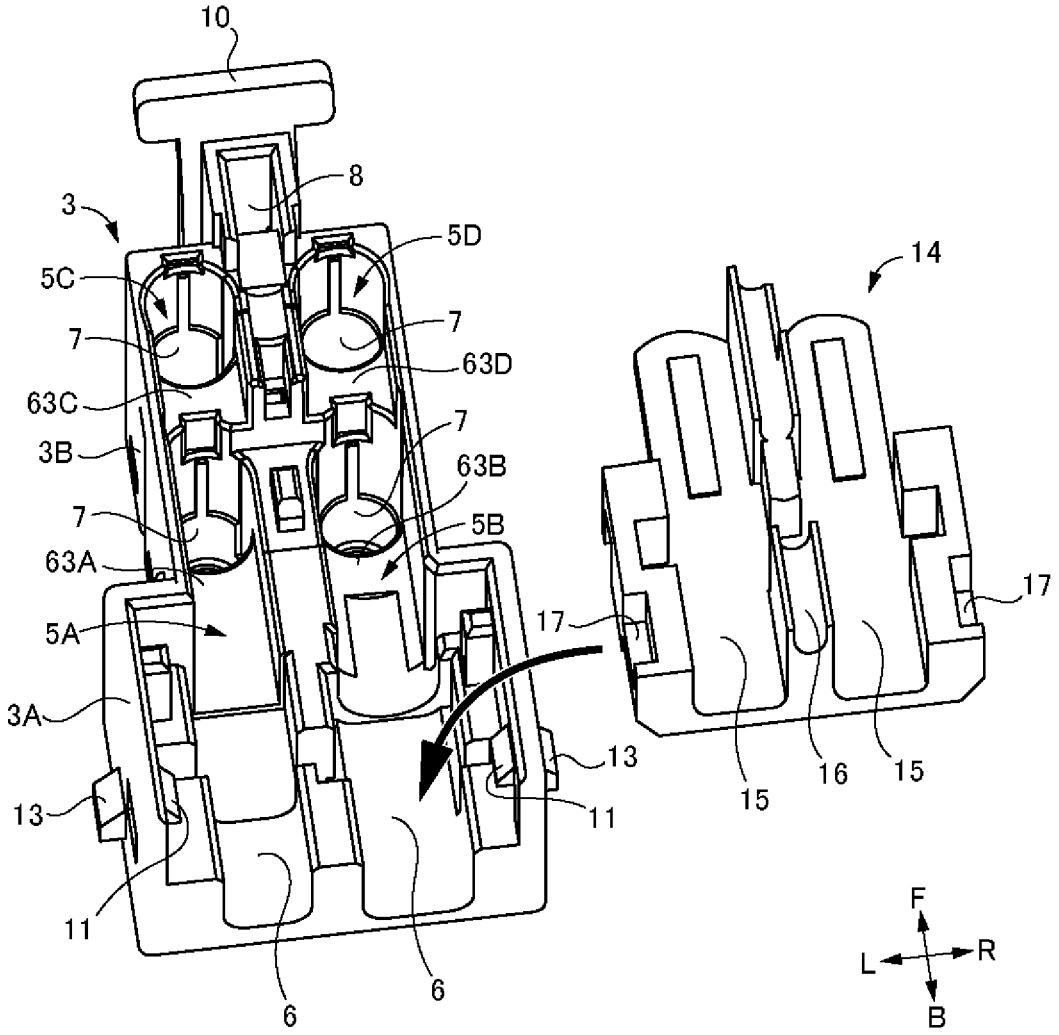

An enlarged view showing the front of the housing main body illustrated in FIG. 5.

FIG. 18

Figure 17:
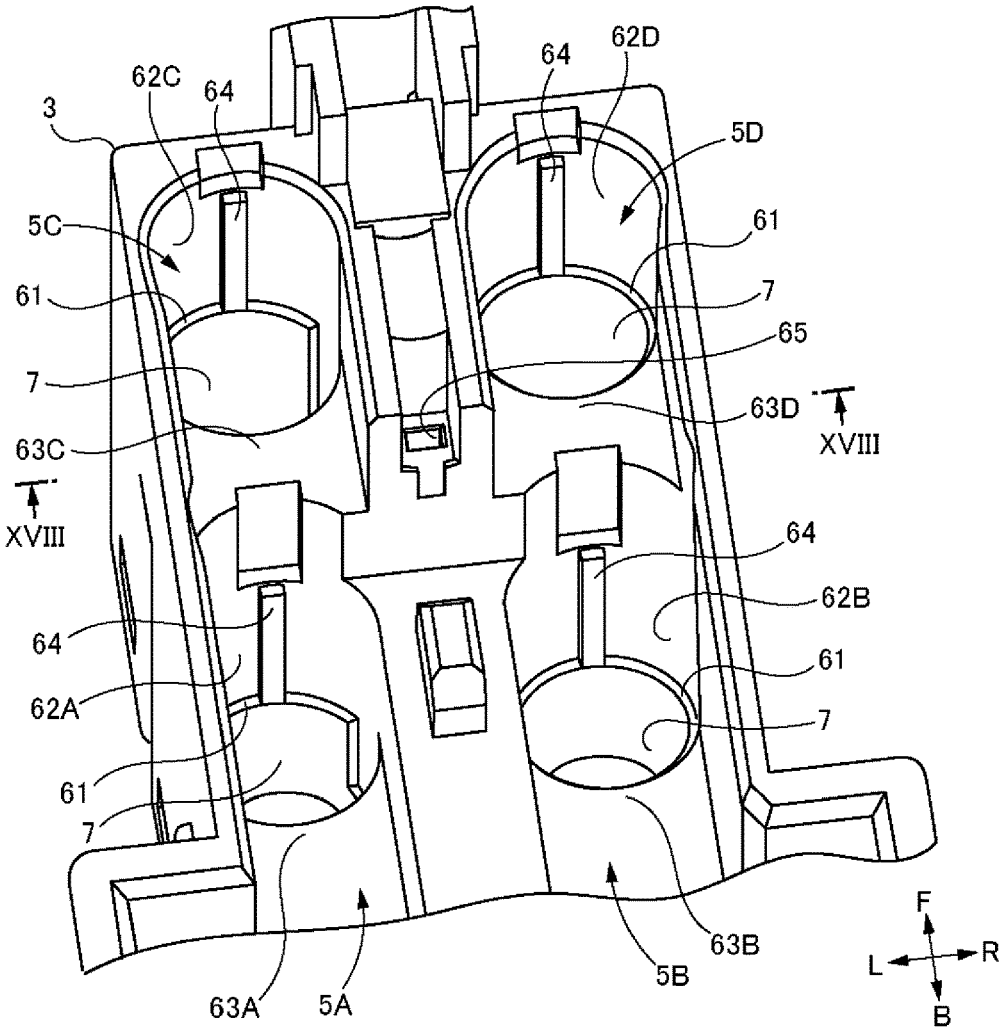

A cross-section of the housing main body shown in FIG. 17, as viewed in the direction of arrows XVIII-XVIII.

FIG. 19

An external view illustrating the first through fourth shielding members and the coupling member mounted to the housing main body in the connector according to the inventive embodiment.

FIG. 20

An external view illustrating the second coaxial terminal held within the housing main body to which the first through fourth shielding members and the coupling member are mounted in the connector according to the inventive embodiment.

DETAILED DESCRIPTION

An embodiment of the inventive connector is described below. It should be noted that, in the description of the embodiment, for ease of explanation, the arrows drawn in the bottom right corner in FIG. 1 through FIG. 20 are used when discussing the front/forward (F), back/rearward (B), left (L), right (R), upward (U), and downward (D) directions in connection with the shape, arrangement, or operation, etc., of the connector or its constituent elements.

(Overall Connector Configuration)

Figure 1:
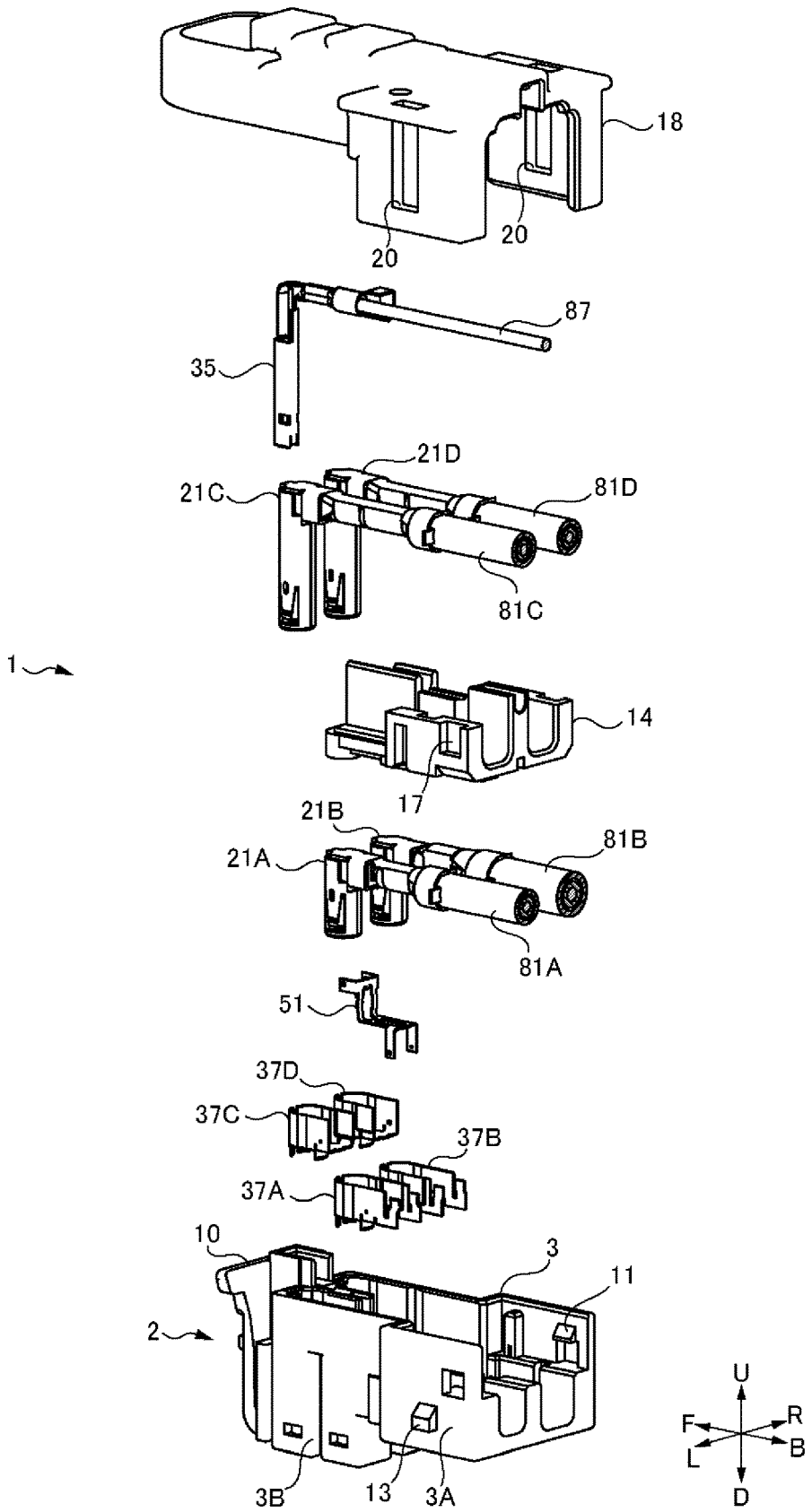
FIG. 1

As shown in FIG. 1, the connector 1 according to the inventive embodiment is provided with a housing 2 made up of a housing main body 3, a spacer 14, and a cover 18; four L-shaped coaxial terminals 21A-21D; an L-shaped power supply terminal 35; four shielding members 37A-37D; and a coupling member 51. Four coaxial cables 81A-81D are respectively mounted to the four coaxial terminals 21A-21D. In addition, a power cable 87 is mounted to the power supply terminal 35.

(Housing)

The housing main body 3, spacer 14, and cover 18 are respectively formed from plastic and other insulating materials. The top section of the housing main body 3 is formed substantially in the shape of an open box. As shown in FIG. 1, the housing main body 3 has a first section 3A extending in a forward-rearward direction, and a second section 3B extending downwardly from the front end side of the first section 3A. In addition, a locking piece 10 used to lock the connector 1 to a counterpart connector is provided in the front portion of the housing main body 3.

The spacer 14 is mounted inside the first section 3A of the housing main body 3. As shown in FIG. 5, the spacer 14 is secured to the housing main body 3 via engagement with housing engagement recesses 17 respectively formed on its left and right faces and convex spacer engaging portions 11 respectively formed on left rear and right rear portions of the first section 3A of the housing main body 3.

Figure 3:
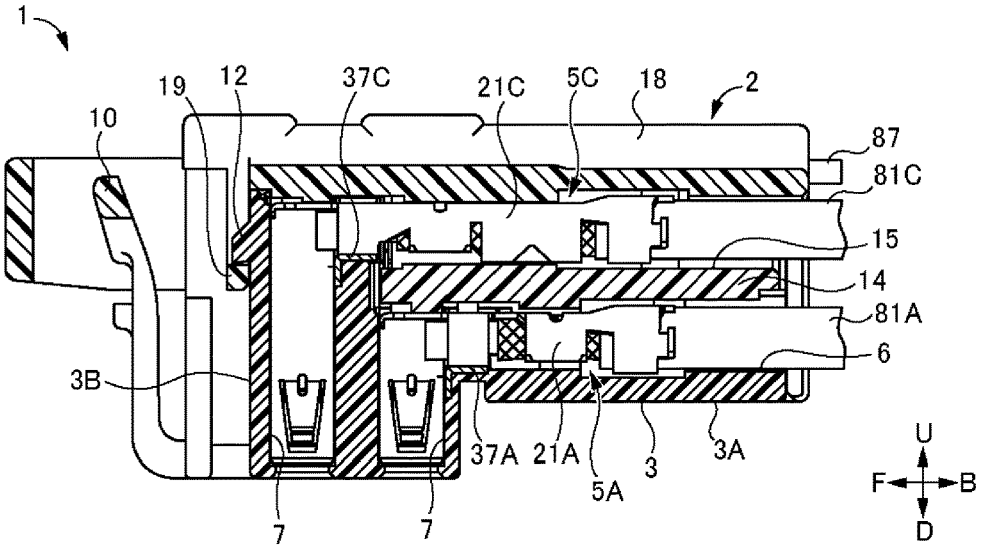

The cover 18 is mounted to the top section of the housing main body 3 and seals the top section of the housing main body 3. As shown in FIG. 3, the front portion of the cover 18 is secured to the front portion of the housing main body 3 via engagement with front locking aperture portions 19 (only the left side is shown) respectively formed in the left and right front portions of said cover 18 and convex front cover engaging portions 12 respectively formed on the left and right sides of the front face of the housing main body 3 (only the left side is shown). In addition, as shown in FIG. 1, the rear portion of the cover 18 is secured to the rear portion of the housing main body 3 via engagement with rear locking aperture portions 20 respectively formed in the left and right rear portions of said cover 18 and convex rear cover engaging portions 13 (see FIG. 5) formed on the rear sides of right and left faces of the housing main body 3.

In addition, four terminal holding portions 5A-5D are provided inside the housing main body 3. As shown in FIG. 3 or FIG. 5, the terminal holding portion 5A, which is a section that holds a coaxial terminal 21A and a shielding member 37A, is disposed in a section extending from the left lower side of the first section 3A of the housing main body 3 to the left rear side of the second section 3B. The terminal holding portion 5B, which is a section that holds a coaxial terminal 21B and a shielding member 37B, is disposed in a section extending from the right lower side of the first section 3A to the right rear side of the second section 3B. The terminal holding portions 5A, 5B, which are respectively made up of terminal holding grooves 6 extending through the first section 3A in a forward-rearward direction and terminal holding openings 7 extending through the second section 3B in the vertical direction, are L-shaped as a whole.

In addition, the terminal holding portion 5C, which is a section that holds a coaxial terminal 21C and a shielding member 37C, is disposed in a section extending from the left upper side of the first section 3A to the left front side of the second section 3B. The terminal holding portion 5D, which is a section that holds a coaxial terminal 21D and a shielding member 37D, is disposed in a section extending from the right upper side of the first section 3A to the right front side of the second section 3B. The third and fourth terminal holding portions 5C, 5D, which are respectively made up of terminal holding grooves 15 formed in the spacer 14 extending in a forward-rearward direction and terminal holding openings 7 extending through the second section 3B of the housing main body 3 in the vertical direction, are L-shaped as a whole. In addition, the spacer 14 is disposed above the two terminal holding grooves 6 inside the first section 3A of the housing main body 3.

Further, a power supply terminal insertion opening 8 used to hold the power supply terminal 35 is formed in the side-to-side central portion of the front portion of the second section 3B of the housing main body 3, and a power cable installation portion 16 in which the power cable 87 is disposed is formed in the side-to-side central portion of the spacer 14.

Figure 4:
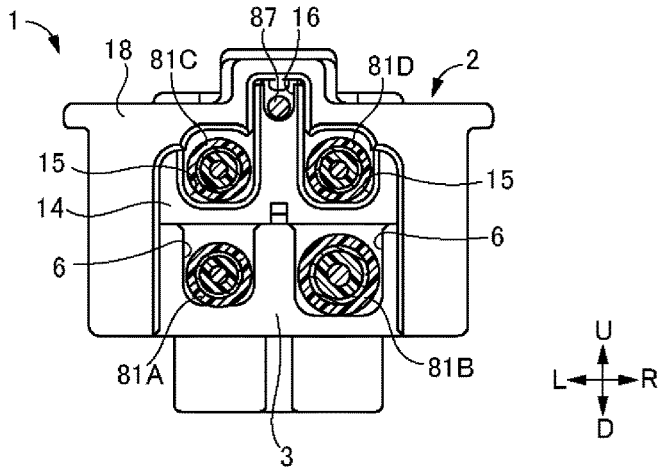

In addition, as shown in FIG. 4, the terminal holding grooves 6, 15 and the power cable installation portion 16 extend to the rear end of the housing 2 and pass out of the housing 2. Further, as shown in FIG. 2, the terminal holding openings 7 and the power supply terminal insertion opening 8 are formed in the bottom face of the second section 3B of the housing main body 3.

(Coaxial Terminals)

Figure 7:
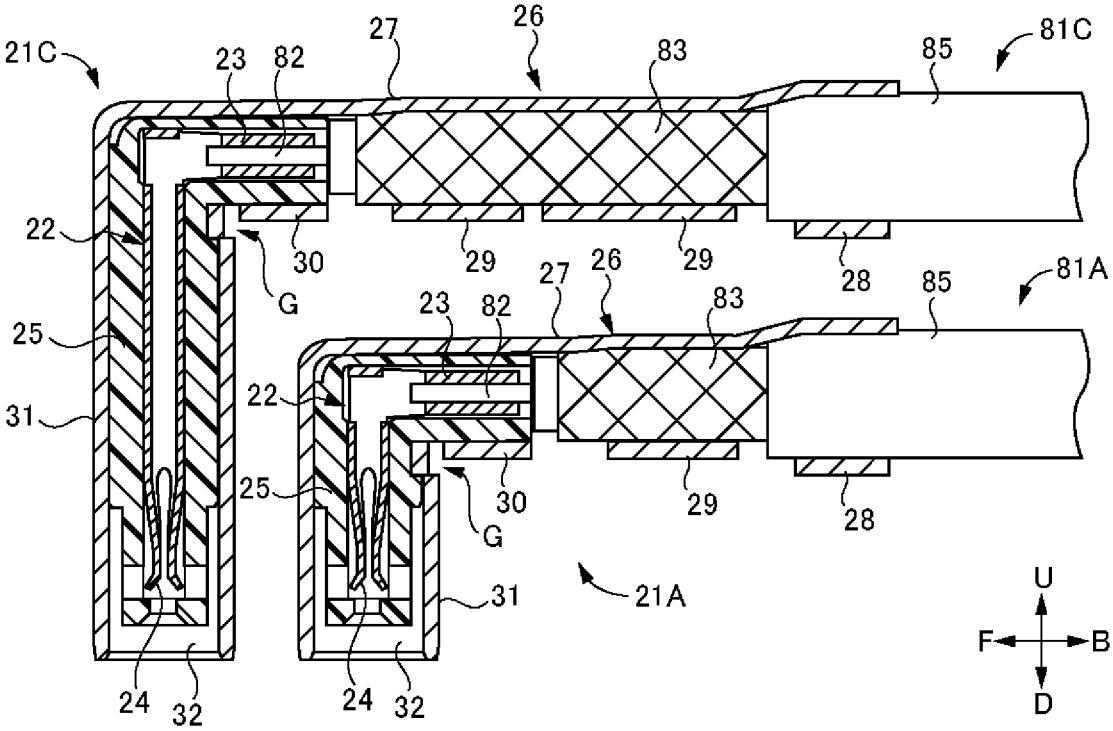

As shown in FIG. 6 and FIG. 7, the coaxial terminal 21A (the first coaxial terminal) has an internal terminal 22, an external terminal 26 provided on the outer periphery of the internal terminal 22, and an insulating member 25 provided between the internal terminal 22 and the external terminal 26.

The internal terminal 22 is L-shaped and formed from an electrically conductive material. At the rearward-facing end of the internal terminal 22, there is formed an inner conductor barrel 23 used to apply pressure to the inner conductor 82 of the coaxial cable 81A. In addition, at the downwardly facing end of the internal terminal 22, there is formed a tubular inner mating portion 24 that mates with an internal terminal of a coaxial terminal in a counterpart connector. The insulating member 25 is formed from an insulating material in the shape of a curved L-shaped tube and surrounds the outer periphery of the internal terminal 22.

The external terminal 26 is L-shaped and formed from an electrically conductive material. The external terminal 26 has a conductor mounting portion 27 extending in a forward-rearward direction and a terminal connecting portion 31 extending downwardly from the front end side of the conductor mounting portion 27. The conductor mounting portion 27 is a section used to mount the outer conductor 83, etc., of the coaxial cable 81A. A sheathing barrel 28 applying pressure to the protective sheathing 85 of the coaxial cable 81A, an outer conductor barrel 29 applying pressure to the outer conductor 83 of the coaxial cable 81A, and a supporting portion 30 supporting the rearward-facing end of the insulating member 25 are successively formed in the conductor mounting portion 27 from its rear end to its front end side. The terminal connecting portion 31 is a section connected to an external terminal of a coaxial terminal in a counterpart connector. In the bottom section of the terminal connecting portion 31, there is formed external mating portion 32 for mating with an external terminal of a coaxial terminal in a counterpart connector.

The external terminal 26 is manufactured, for example, by punching a metal sheet to form a metal sheet piece with an unfolded shape corresponding to the external terminal 26 and then bending this metal sheet piece. The terminal connecting portion 31 is bent such that it surrounds the outer periphery of the insulating member 25 and has a tubular shape. The supporting portion 30 is bent into a box-like tubular shape such that it surrounds the outer periphery of the rearward-facing end portion of the insulating member 25. The sheathing barrel 28 and the outer conductor barrel 29 are respectively bent into a tubular shape as pressure is applied to the outer conductor 83 and the protective sheathing 85 of the coaxial cable 81A. In such a structure, as shown in FIG. 7, a gap G is formed in the external terminal 26 on the inside of the curved L-shaped section.

The coaxial terminal 21B (second coaxial terminal) is formed as a mirror image of the coaxial terminal 21A. Since the coaxial terminal 21C (third coaxial terminal) is disposed outwardly of the coaxial terminal 21A inside the housing 2, its dimensions in the vertical direction and in the forward-rearward direction are made respectively larger in comparison with the coaxial terminal 21A. The coaxial terminal 21C is otherwise formed in the same manner as the coaxial terminal 21A. The coaxial terminal 21D (fourth coaxial terminal) is formed as a mirror image of the coaxial terminal 21C.

(Shielding Members)

Figure 12:
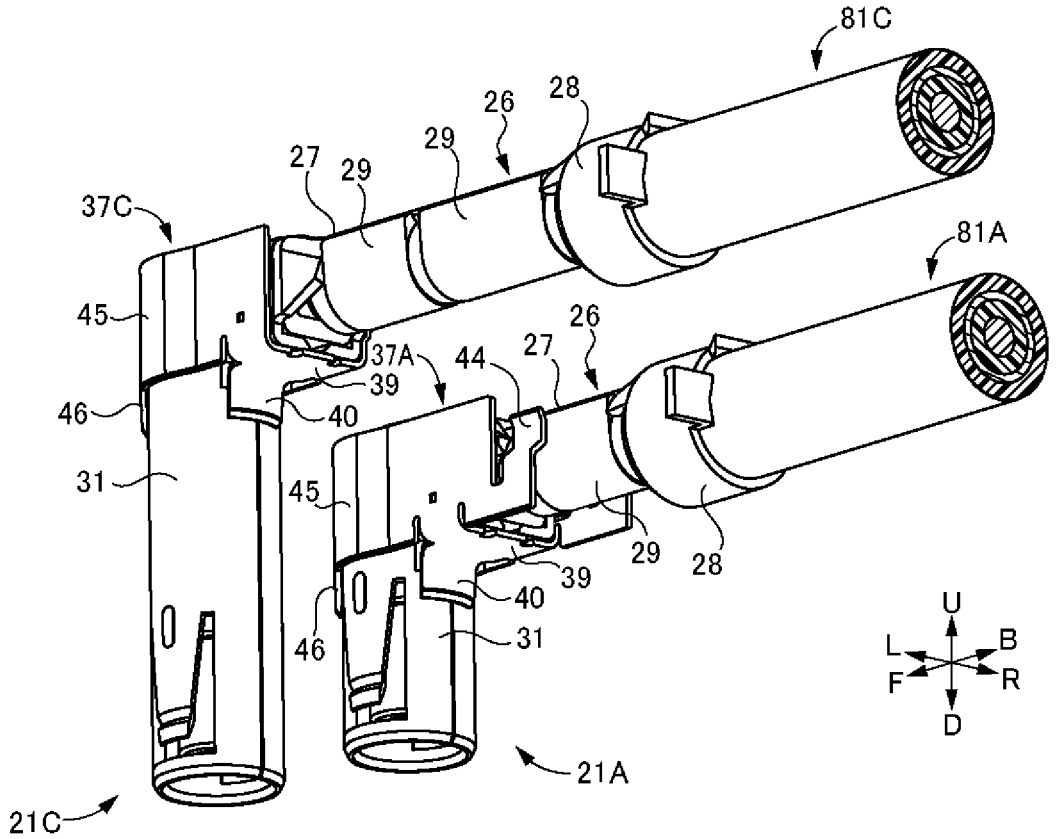

As shown in FIG. 12, the shielding member 37A (first shielding member) is a member that primarily shields the inside of the curved L-shaped section in the external terminal 26 of the coaxial terminal 21A. The shielding member 37A, which is made up of an electrically conductive material such as copper or other metallic material, is formed, specifically, by press-forming a copper plate, for example.

As shown in FIG. 8, the shielding member 37A is provided with a base portion 38 and a pair of extension portions 45. The base portion 38 of the shielding member 37A is disposed in an area extending from below the front end portion of the conductor mounting portion 27 to the rear of the upper end portion of the terminal connecting portion 31 in the external terminal 26 of the coaxial terminal 21A and covers a section extending from the bottom face of the front end portion of the conductor mounting portion 27 to the rear face of the upper end portion of the terminal connecting portion 31 in said external terminal 26. In addition, the base portion 38 of the shielding member 37A electrically connects the terminal connecting portion 31 and the conductor mounting portion 27 of said external terminal 26, thereby forming an electrical path passing through the area extending from below the front end portion of the conductor mounting portion 27 to the rear of the upper end portion of the terminal connecting portion 31 in said external terminal 26.

The base portion 38 of the shielding member 37A has a bottom plate portion 39, a front plate portion 40, and left and right lateral plate portions 41. The bottom plate portion 39 is formed in the shape of a plate extending in a forward-rearward-left-right direction, and the upper face of the bottom plate portion 39 faces the bottom face of the front end portion of the conductor mounting portion 27 of the coaxial terminal 21A. While the bottom plate portion 39 and the bottom face of the front end portion of said conductor mounting portion 27 are desirably in mutual contact, it is sufficient for them to approach each other without necessarily being in contact.

Figure 9:
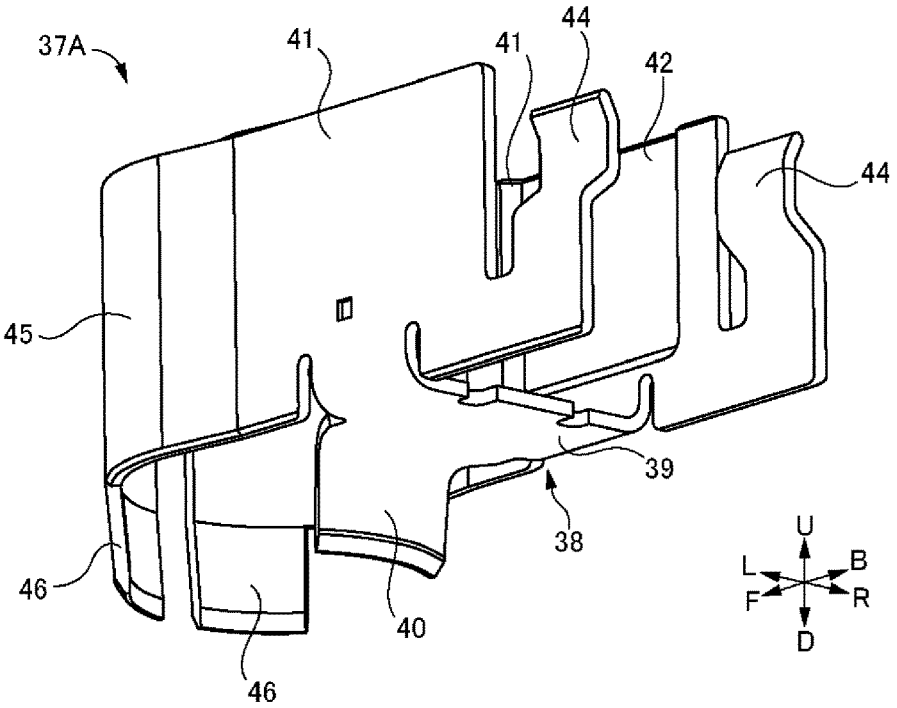
Figure 14:
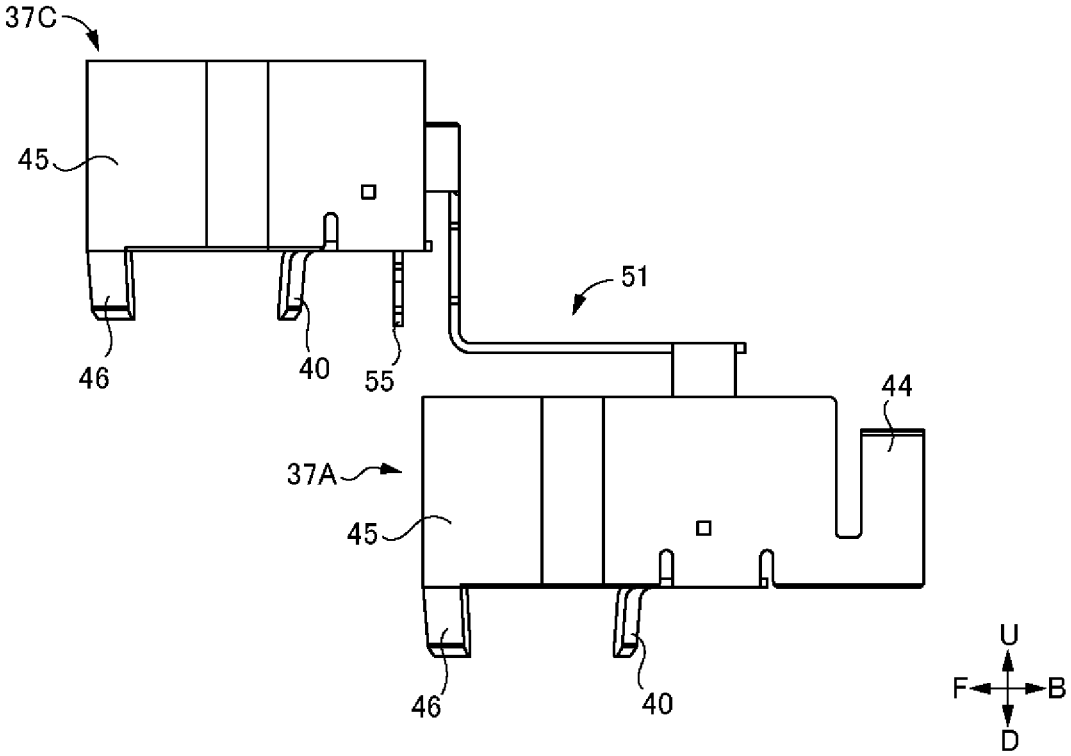

As shown in FIG. 9, the front plate portion 40 is formed in the shape of a plate extending downwardly from the front edge of the bottom plate portion 39 and extending in an upward-downward-left-right direction. The front face of the front plate portion 40 is in contact with the rear face of the upper end portion of the terminal connecting portion 31 in the external terminal 26 of the coaxial terminal 21A. As shown in FIG. 8 or FIG. 13, the front plate portion 40 is curved such that the side-to-side central portion is rearwardly recessed; this curved shape generally corresponds to the curved shape of the rear face of the upper end portion of said terminal connecting portion 31. In addition, as shown in FIG. 14, the front plate portion 40 slopes slightly forward as it extends downwardly. As a result of the above-mentioned curved shape and sloping of the front plate portion 40, the front plate portion 40 is placed in firm contact with the rear face of the upper end portion of the terminal connecting portion 31 of the coaxial terminal 21A.

Figure 15:
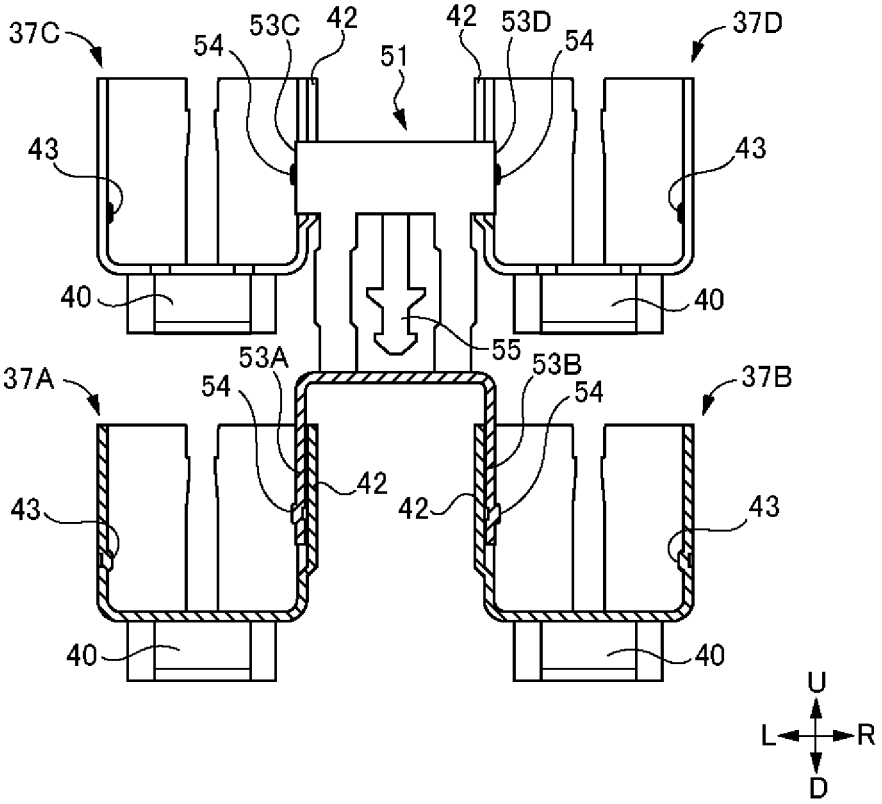

As shown in FIG. 8, the lateral plate portions 41 extend upwardly respectively from the left and right edges of the bottom plate portion 39. In addition, an overhang portion 42 protruding to the right is formed in the right side lateral plate portion 41 for the placement of the contact piece 53A of the coupling member 51. Further, as shown in FIG. 13 or FIG. 15, a prong 43 protruding to the right is formed on the left side lateral plate portion 41. This prong 43 is brought in contact with the left face of the front end portion of the conductor mounting portion 27 of the external terminal 26 of the coaxial terminal 21A.

The extension portions 45 have the capability to apply pressure to the front face of the terminal connecting portion 31 of the coaxial terminal 21A to thereby bring the rear face of the upper end portion of said terminal connecting portion 31 in contact with the front plate portion 40. As shown in FIG. 8, the extension portions 45 extend from the lateral plate portions 41 via the lateral sides of the terminal connecting portion 31 to the front of the terminal connecting portion 31. The front ends of the left and right extension portions 45 approach each other. In addition, the front end side sections of the extension portions 45 are provided with downwardly extending protrusions 46, and, as shown in FIG. 14, each protrusion 46 slopes rearwardly as it extends downwardly. The protrusions 46 apply pressure to the front face of the terminal connecting portion 31 of the coaxial terminal 21A. The pushing force is enhanced by the sloping of the protrusions 46. This causes the rear face of the upper end portion of said terminal connecting portion 31 to be pressed against the front plate portion 40, thereby placing them in firm contact with each other. In addition, at the front edges of the left and right extension portions 45, there are respectively provided pressure contact portions 47 protruding from said front edges towards each other. As described hereafter, the pressure contact portions 47 have the capability to temporarily lock the shielding member 37A to a shielding mounting portion 62A of the housing main body 3.

In addition, the lateral plate portions 41 extend more rearwardly than the bottom plate portion 39, and rear side contact portions 44, which are used to electrically connect the outer conductor barrel 29 and the supporting portion 30 of the coaxial terminal 21A, are provided on the rear end sides of the lateral plate portions 41. After rearwardly extending from the lateral plate portions 41, the left and right rear side contact portions 44 extend upwardly, and their distal ends are respectively brought in contact with the left and right faces of the outer conductor barrel 29.

Figure 11:
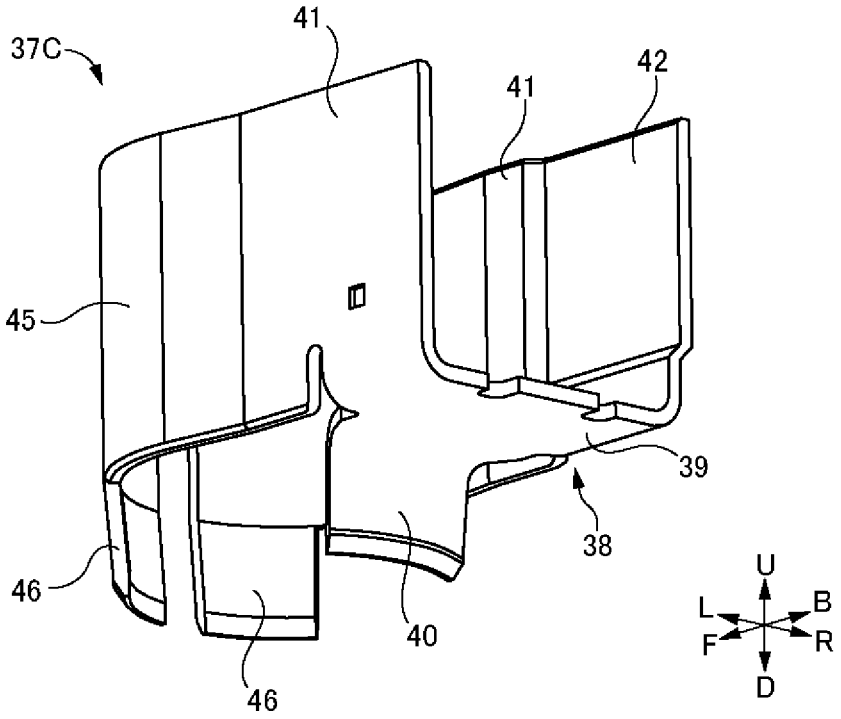

The shielding member 37B (second shielding member) is a member that primarily shields the inside of the curved L-shaped section in the external terminal 26 of the coaxial terminal 21B. The shielding member 37B is formed as a mirror image of the shielding member 37A. In addition, the shielding member 37C (third shielding member) is a member that shields the inside of the curved L-shaped section in the external terminal 26 of the coaxial terminal 21C. As shown in FIG. 10 and FIG. 11, the shielding member 37C is formed in substantially the same manner as the shielding member 37A with the exception that the lateral plate portions 41 do not extend more rearwardly than the bottom plate portion 39 and no rear side contact portions 44 are provided on the lateral plate portions 41. Further, the shielding member 37D (fourth shielding member) is a member that shields the inside of the curved L-shaped section in the external terminal 26 of the coaxial terminal 21D. The shielding member 37D is formed as a mirror image of the shielding member 37C.

(Coupling Member)

Figure 16:
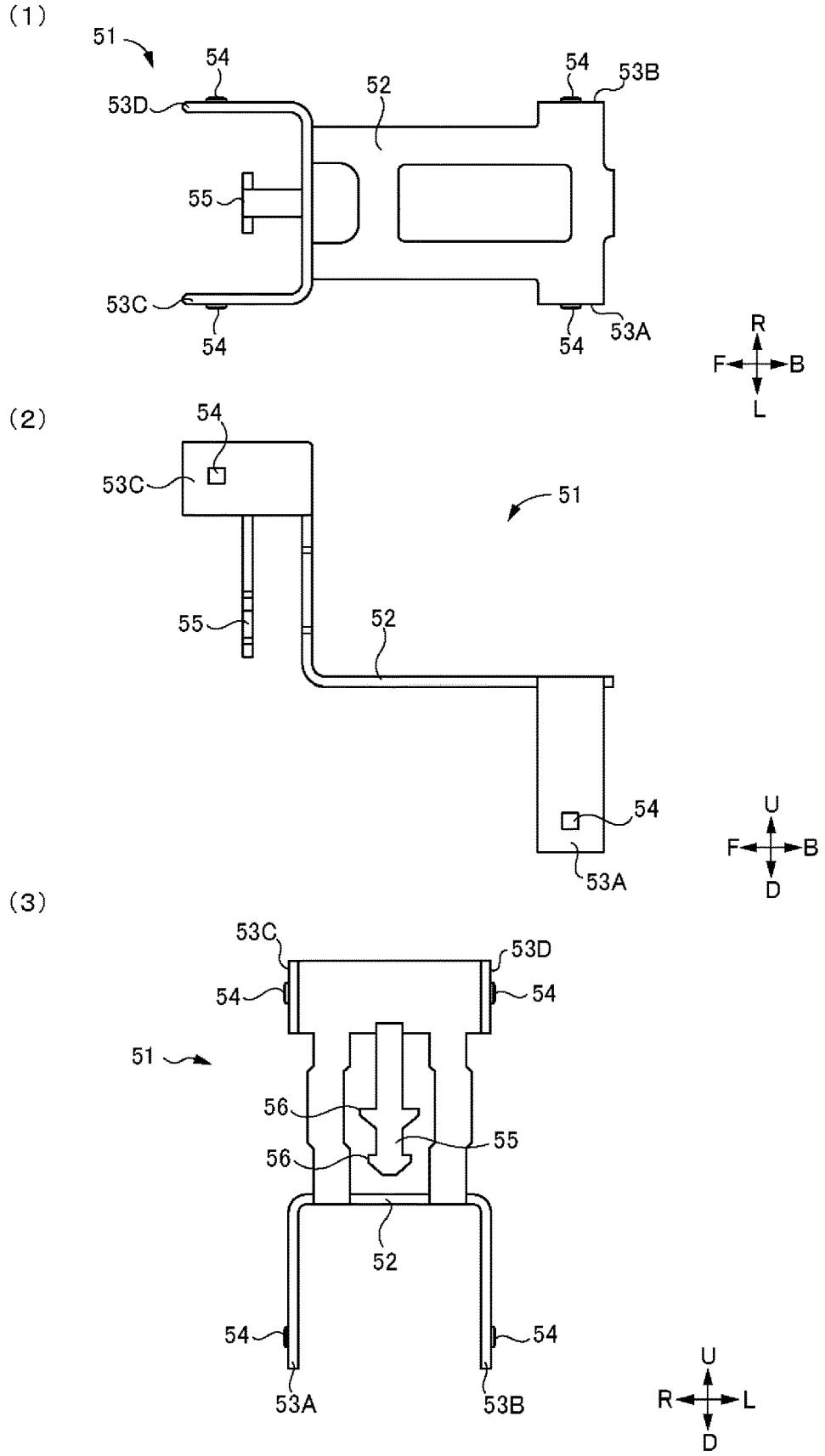

The coupling member 51, which is a member that electrically connects the four shielding members 37A-37D, is formed from an electrically conductive material such as copper or other metallic material. As shown in FIG. 16, the coupling member 51 is provided with a main body portion 52, four contact pieces 53A-53D, and a securing portion 55. The main body portion 52 is formed in the shape of an L-shaped plate which, after extending forwardly, is bent and extends upwardly. The contact pieces 53A, 53B extend downwardly from, respectively, the left and right end portions of the rearward-facing end portion of the main body portion 52. The contact pieces 53C, 53D extend forwardly from, respectively, the left and right end portions of the upward-facing end portion of the main body portion 52.

As shown in FIG. 15, the contact pieces 53A, 53B enter the respective base portions 38 of the shielding members 37A, 37B from above the respective base portions 38 and are brought in contact with the inner surface of the respective overhang portions 42 of the shielding members 37A, 37B. Further, as shown in FIG. 13, the contact pieces 53C, 53D enter the respective base portions 38 of the shielding members 37C, 37D from behind the respective base portions 38 and are brought in contact with the inner surfaces of the respective overhang portions 42 of the shielding members 37C, 37D.

In addition, outwardly protruding prongs 54 are formed on the exterior surface of the distal ends of the contact pieces 53A-53D. The prongs 54 of the contact pieces 53A-53D are brought in contact, respectively, with the right face of the front end portion (specifically, the supporting portion 30) of the conductor mounting portion 27 of the external terminal 26 of the coaxial terminal 21A, the left face of the front end portion of the conductor mounting portion 27 of the external terminal 26 of the coaxial terminal 21B, the right face of the front end portion of the conductor mounting portion 27 of the external terminal 26 of the coaxial terminal 21C, and the left face of the front end portion of the conductor mounting portion 27 of the external terminal 26 of the coaxial terminal 21D.

In addition, the securing portion 55 is a section that secures the coupling member 51 to the housing main body 3. After protruding forwardly from the side-to-side central portion at the upward-facing end portion of the main body portion 52, the securing portion 55 is bent and extends downwardly. As shown in FIG. 16 (3), multiple laterally protruding extraction-preventing portions 56 are formed on the distal end side of the securing portion 55. As indicated by the two-dot chain line in FIG. 18, the securing portion 55 is inserted into a securing opening 65 formed in the housing main body 3. Inside the securing opening 65, the distal ends of the extraction-preventing portions 56 engage the peripheral surface of the securing opening 65, thereby allowing for the coupling member 51 to be secured to the housing main body 3.

(Mounting of Shielding Members, Coupling Member, etc.)

As shown in FIG. 17, a stepped portion 61 is formed in the top peripheral surface of the terminal holding opening 7 of the terminal holding portion 5A and the diameter dimensions of the section located above the stepped portion 61 in the terminal holding opening 7 are made larger in comparison with the section located below the stepped portion 61. Further, a shielding mounting portion 62A, which is used to mount the shielding member 37A, is formed in the section located above the stepped portion 61. In the same manner, shielding mounting portions 62B, 62C, and 62D, which are used to mount the shielding members 37B, 37C, and 37D, are also respectively formed in the terminal holding portions 5B, 5C, and 5D.

Figure 19:
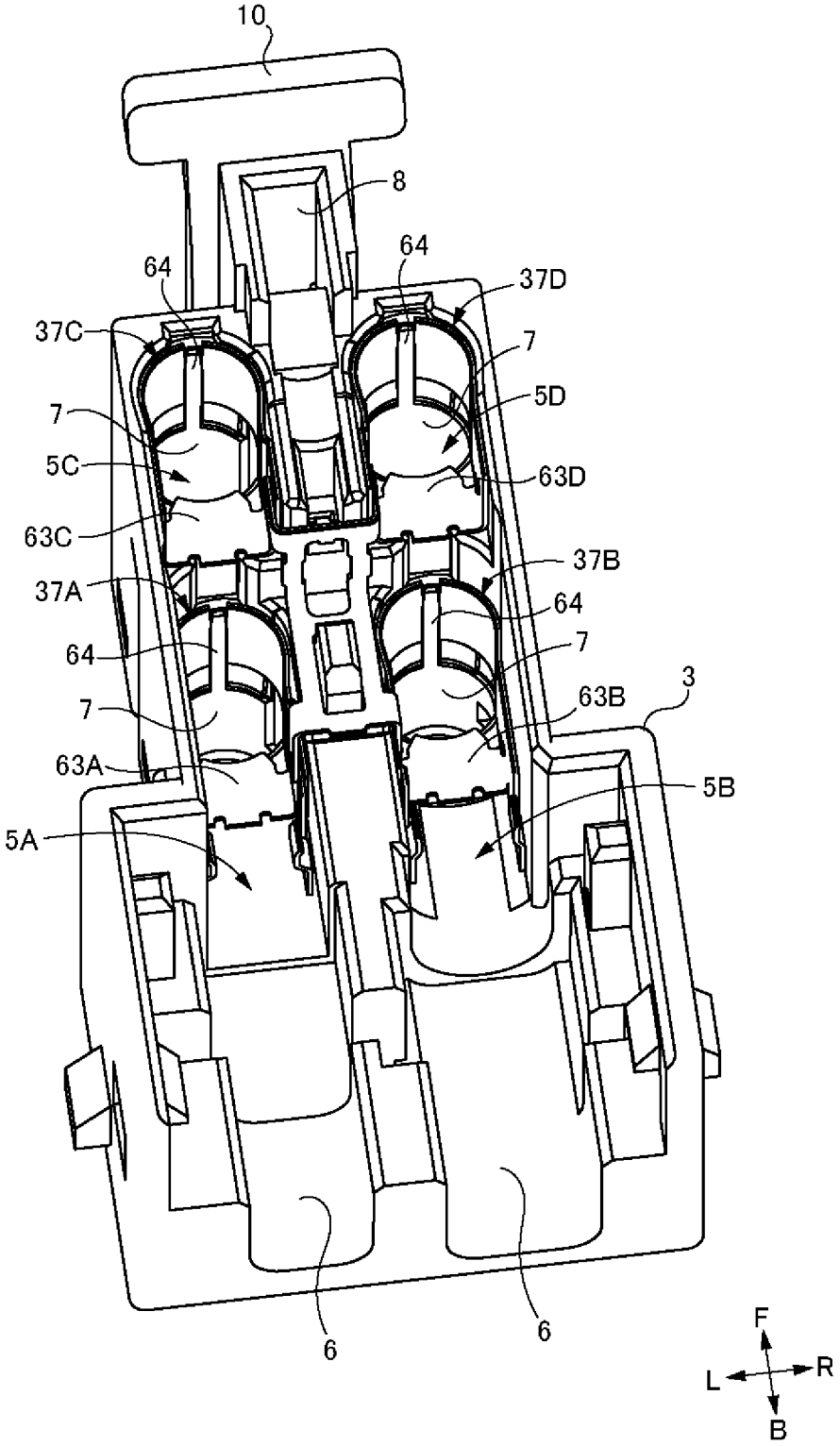

As shown in FIG. 17, the terminal holding portions 5A-5D of the housing main body 3 respectively have L-shaped curved portions 63A-63D. The shielding mounting portions 62A-62D are respectively located in the curved portions 63A-63D. As shown in FIG. 19, as a result of mounting the shielding members 37A-37D respectively in the shielding mounting portions 62A-62D, the shielding members 37A-37D are respectively disposed in the curved portions 63A-63D.

Further, a projection 64 is formed in the front portion of the section located above the stepped portion 61 on the peripheral surface of the terminal holding opening 7 of the terminal holding portion 5A. The projection 64 protrudes inward from the peripheral surface of the terminal holding opening 7 and extends upwardly from the stepped portion 61. When the shielding member 37A is mounted to the shielding mounting portion 62A, the projection 64 of the terminal holding portion 5A is inserted between the front edges of the left and right extension portions 45 of the shielding member 37A. In this state, the pressure contact portions 47 provided at the front edges of the extension portions 45 press against the lateral faces of the projection 64. This results in a state in which the shielding member 37A is positioned inside the shielding mounting portion 62A and cannot be moved if a relatively weak force is applied thereto (a temporarily locked state). In addition, the same projections 64 are also formed in the terminal holding portions 5B, 5C, and 5D. The pressure contact portions 47 of the shielding members 37B, 37C, and 37D respectively press against the lateral faces of the projections 64 of the terminal holding portions 5B, 5C, and 5D, which results in a state in which the shielding members 37B, 37C, and 37D are respectively temporarily locked inside the shielding mounting portions 62B, 62C, and 62D.

Further, as shown in FIG. 19, the coupling member 51 is disposed in an area surrounded by the shielding members 37A-37D mounted to the shielding mounting portions 62A-62D. In this state, the contact pieces 53A-53D of the coupling member 51 are respectively inserted into the base portions 38 of the shielding members 37A-37D and are respectively in contact with the inner surfaces of the overhang portions 42 of the shielding members 37A-37D.

Figure 18:
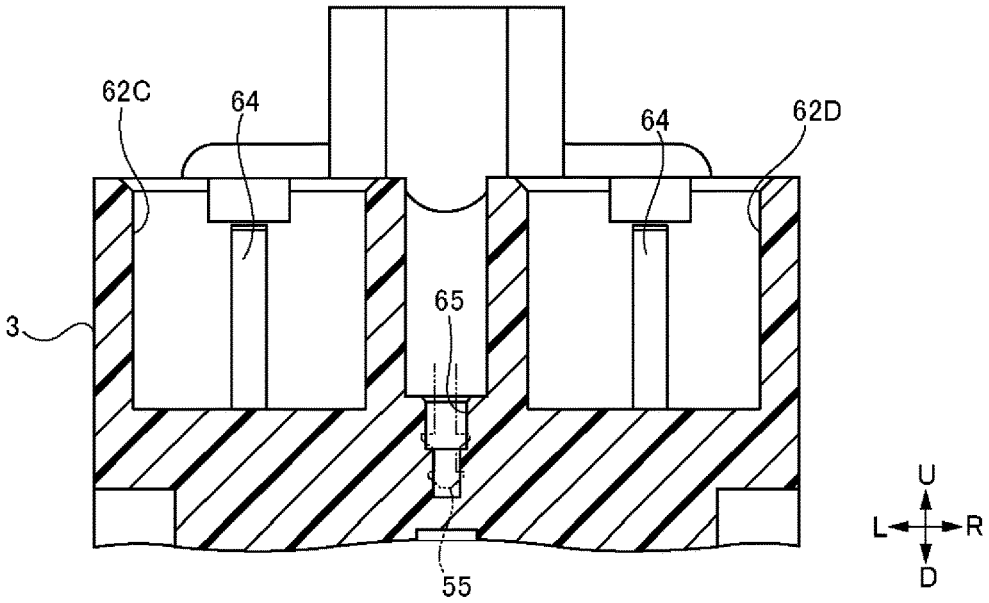

In addition, as shown in FIG. 17, a securing opening 65 is formed in a substantially central portion of the area surrounded by the four curved portions 63A-63D in the housing main body 3. As shown in FIG. 18, the coupling member 51 is secured to the housing main body 3 by inserting the securing portion 55 into the securing opening 65. In addition, as can be seen from FIG. 13, FIG. 15, and FIG. 19, the overhang portion 42 of the shielding member 37A is sandwiched between the housing main body 3 and the contact piece 53A of the coupling member 51. In this state, the coupling member 51 is secured to the housing main body 3 by the securing portion 55, as a result of which the shielding member 37A is supported by the housing main body 3 via the contact piece 53A. In the same manner, the shielding members 37B, 37C, and 37D are supported by the housing main body 3 via the contact pieces 53B, 53C, and 53D.

Figure 20:
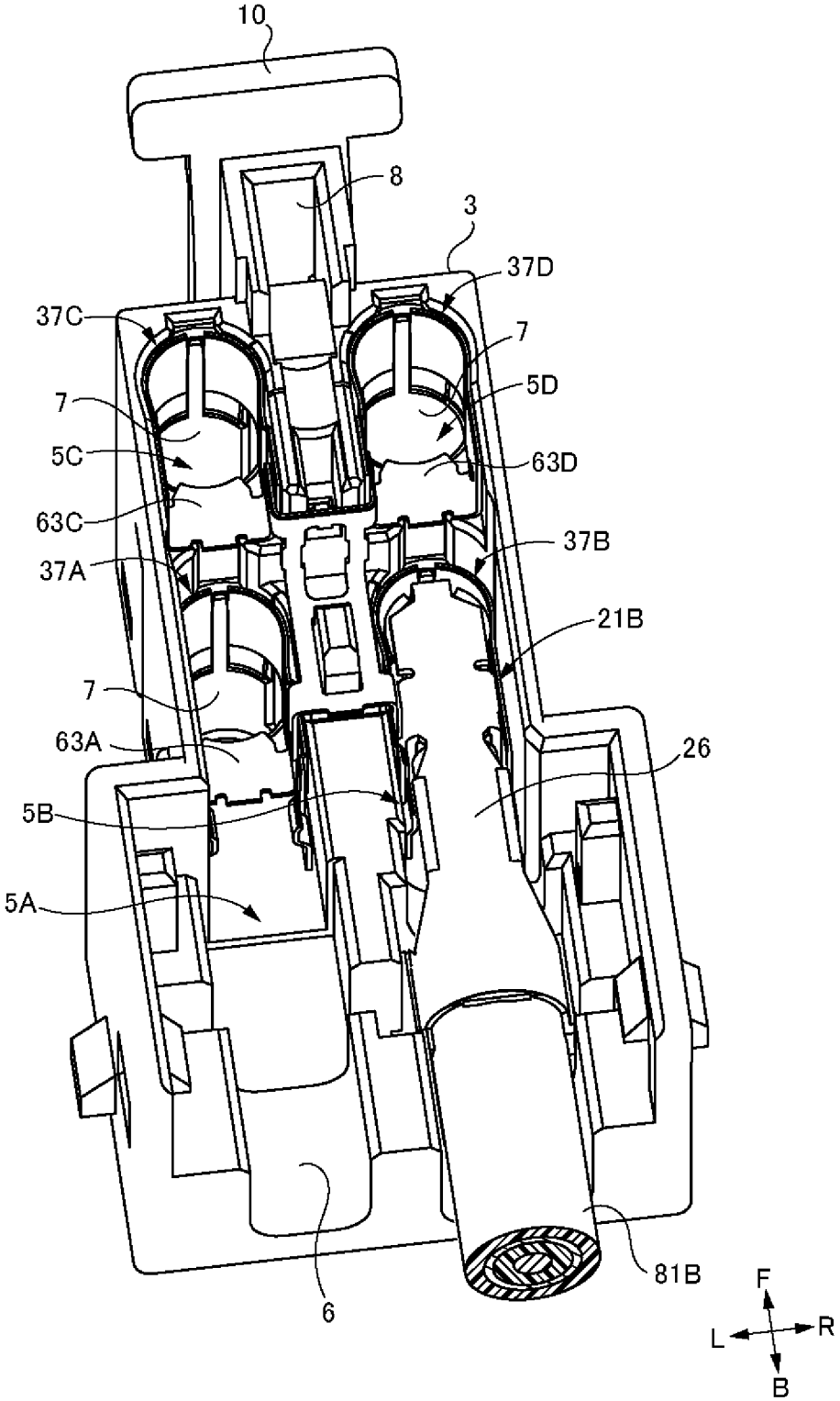

For ease of explanation, FIG. 20 illustrates a state in which only the coaxial terminal 21B is held in the housing main body 3 to which the shielding members 37A-37D and the coupling member 51 are mounted. As shown in FIG. 20, the coaxial terminal 21B is held in the terminal holding portion 5B of the housing main body 3. Specifically, first, the terminal connecting portion 31 of the external terminal 26 of the coaxial terminal 21B is inserted into the terminal holding opening 7 of the terminal holding portion 5B from above said terminal holding opening 7 by passing between the extension portions 45 and the front plate portion 40 of the shielding member 37B. Subsequently, the conductor mounting portion 27 of the external terminal 26 of the coaxial terminal 21B is disposed in the terminal holding groove 6 of the terminal holding portion 5B.

With the coaxial terminal 21B thus held in the terminal holding portion 5B, the bottom face of the front end portion of the conductor mounting portion 27 of the external terminal 26 of the terminal holding portion 5B and the upper face of the bottom plate portion 39 of the shielding member 37B are in proximity or contact with each other. In addition, the front face of the upper end portion of the terminal connecting portion 31 of said external terminal 26 is pushed against the extension portions 45 (protrusions 46) of the shielding member 37D, and the rear face of the upper end portion of the terminal connecting portion 31 of said external terminal 26 is brought in firm contact with the front plate portion 40 of the shielding member 37D. Further, the prong 43 formed on the left side lateral plate portion 41 of the shielding member 37B is brought in contact with the right face of the supporting portion 30 of the conductor mounting portion 27 of said external terminal 26. In addition, the rear side contact portions 44 of the shielding member 37B are brought in contact with the lateral faces of the outer conductor barrel 29 of said external terminal 26. Further, the prong 54 formed on the contact piece 53B of the coupling member 51 is brought in contact with the left face of the supporting portion 30 of the conductor mounting portion 27 of said external terminal 26. Furthermore, as a result of bringing the prong 54 of the contact piece 53B of the coupling member 51 in contact with the left face of the supporting portion 30 of the conductor mounting portion 27 of said external terminal 26, the contact piece 53B is pushed to the left, and the left face of the contact piece 53B and the inner surface (right face) of the overhang portion 42 of the shielding member 37B are brought in firm contact with each other.

As a result, the inside of the curved L-shaped section of said external terminal 26 is covered by the front plate portion 40 and bottom plate portion 39 of the shielding member 37B and the gap formed on the inside of said curved section of the coaxial terminal 21B is sealed. In addition, a short electrical path electrically connecting the conductor mounting portion 27 of said external terminal 26 and the terminal connecting portion 31 is formed by the shielding member 37B on the inside of the above-mentioned curved section of said external terminal 26. Further, a short electrical path connecting the outer conductor barrel 29 of said external terminal 26 and the supporting portion 30 disposed in front of it is formed by the rear side contact portions 44. In addition, said external terminal 26 and the shielding member 37B are electrically connected to the coupling member 51.

Further, when the coaxial terminal 21A is held in the terminal holding portion 5A, the same state is obtained as when the coaxial terminal 21B is held in the terminal holding portion 5B. In addition, when the coaxial terminal 21C is held in the terminal holding portion 5C and when the coaxial terminal 21D is held in the terminal holding portion 5D, the same state is obtained as when the coaxial terminal 21B is held in the terminal holding portion 5B with the exception that there is no contact between the rear side contact portions 44 and the outer conductor barrel 29.

(Method of Connector Assembly)

The method of assembly (method of manufacture) of the connector 1 is, for example, as follows. First, as shown in FIG. 19, the shielding members 37A-37D are respectively mounted to the shielding mounting portions 62A-62D of the housing main body 3. Next, the coupling member 51 is disposed in the area surrounded by the shielding members 37A-37D inside the housing main body 3 and the securing portion 55 of the coupling member 51 is secured in the securing opening 65. At such time, the contact pieces 53A-53D of the coupling member 51 are inserted into the respective base portions 38 of the shielding members 37A-37D, e.g., from above the respective base portions 38, and the distal ends of the contact pieces 53A-53D are brought in contact with the inner surfaces of the respective overhang portions 42 of the shielding members 37A-37D. Next, the coaxial terminal 21A to which the coaxial cable 81A is mounted and the coaxial terminal 21B to which the coaxial cable 81B is mounted are placed, respectively, in the terminal holding portion 5A and in the terminal holding portion 5B. Next, the spacer 14 is installed inside the housing main body 3. Next, the coaxial terminal 21C to which the coaxial cable 81C is mounted and the coaxial terminal 21D to which the coaxial cable 81D is mounted are placed, respectively, in the terminal holding portion 5C and in the terminal holding portion 5D. Next, the cover 18 is mounted to the housing main body 3. This completes the assembly of the connector 1.

Since, as described above, the connector 1 according to the inventive embodiment uses a configuration in which the section extending from the bottom face of the front end portion of the conductor mounting portion 27 to the rear face of the upper end portion of the terminal connecting portion 31 in the respective external terminals 26 of the coaxial terminals 21A-21D is covered by the shielding members 37A-37D, the gaps G (see FIG. 7) formed on the inside of the curved L-shaped sections of the respective coaxial terminals 21A-21D can be covered by the shielding members 37A-37D. This makes it possible to enhance the shielding effects of the connector 1. Therefore, in the coaxial terminals 21A-21D, leakage of transmitted signals outside the coaxial terminals through the gaps G can be minimized while preventing contamination of said signals by exogenous noise through the gaps G.

In addition, since the connector 1 uses a configuration in which, as a result of providing the shielding members 37A-37D, the terminal connecting portions 31 and the conductor mounting portions 27 of the respective external terminals 26 of the coaxial terminals 21A-21D are electrically connected, and, in the external terminals 26, there is formed an electrical path that passes through an area extending from below the front end portion of the conductor mounting portion 27 to the rear of the upper end portion of the terminal connecting portion 31, the conductor mounting portions 27 and terminal connecting portions 31 of the external terminals 26, which are partially separated due to the presence of the gaps G, can be electrically connected by a short path. This makes it possible to enhance the shielding effects of the connector 1. For example, the inductance of the external terminals 26 can be reduced and electromagnetic coupling between adjacent external terminals 26 can be minimized.

Further, since the connector 1 uses a configuration in which the shielding members 37A-37D are respectively electrically connected by the contact pieces 53A-53D of the coupling member 51, the respective external terminals 26 of the coaxial terminals 21A-21D can be reliably connected to the ground circuits of the electrical and electronic devices to which the connector 1 is connected, and the grounding of the coaxial terminals 21A-21D can be stabilized. Since the grounding of any one of the coaxial terminals 21A-21D is unstable, this makes it possible to minimize backflow of noise currents, etc., from the ground circuits of electronic and electrical devices to the external terminals 26 of the coaxial terminals with unstable grounding.

In addition, the coupling member 51 is disposed in an area surrounded by the shielding members 37A-37D mounted to the shielding mounting portions 62A-62D of the housing main body 3. This can reduce the distance between the coupling member 51 and the shielding members 37A-37D and shorten the electrical path between the coupling member 51 and the shielding members 37A-37D. This can enhance the stability of the grounding of the coaxial terminals 21A-21D.

Further, the connector 1 uses a configuration in which the shielding members 37A-37D are respectively supported by the housing main body 3 by means of the contact pieces 53A-53D of the coupling member 51. This gives the coupling member 51 the capability to electrically connect the shielding members 37A-37D and, at the same time, the capability to support the shielding members 37A-37D. Therefore, there is no need to provide a separate member to support the shielding members 37A-37D and, consequently, the number of parts can be reduced.

In addition, since the connector 1 uses a configuration in which the extension portions 45 (protrusions 46) of the shielding members 37A-37D apply pressure to the front face of the terminal connecting portion 31 of the external terminal 26 of the coaxial terminals 21A-21D to thereby bring the rear face of the upper end portion of the terminal connecting portion 31 in contact with the front plate portion 40 of the shielding members 37A-37D, the rear face of the upper end portion of the terminal connecting portion 31 of the external terminal 26 of the coaxial terminals 21A-21D can be brought in firm contact with the front plate portion 40 of the shielding members 37A-37D. This makes it possible to prevent the rear face of the upper end portion of the terminal connecting portion 31 of the external terminal 26 of the coaxial terminals 21A-21D and the front plate portion 40 of the shielding members 37A-37D from moving away from each other when, for example, vibration is applied to the connector 1.

Further, in the method of assembly (method of manufacture) of the connector 1, the shielding members 37A-37D and the coupling member 51 are mounted to the housing main body 3 and the coaxial terminals 21A-21D are subsequently placed inside the housing main body 3. This makes it possible to assemble the connector 1 more easily in comparison with the method in which the shielding members 37A-37D are mounted to the coaxial terminals 21A-21D, the coaxial terminals 21A-21D to which the shielding members 37A-37D are mounted are then placed in the housing main body 3, and the shielding members 37A-37D are subsequently electrically connected by the coupling member 51.

It should be noted that while the above-mentioned embodiment describes an example in which the connector has four coaxial terminals and four shielding members, the present invention is not limited to this example. In the inventive connector, the respective number of coaxial terminals and shielding members can be 1, 2, or 3, or even 5 or more.

In addition, the inventive method of connector assembly (method of manufacture) is not limited to the method of assembly described in the above-mentioned embodiment. For example, it is possible to use a method of assembly in which the shielding members are mounted to the coaxial terminals, and the coaxial terminals to which the shielding members are thus mounted are then placed in the housing main body.

Further, where consistent with the essence or concept of the present invention which can be read from the claims and description in their entirety, the present invention may be modified as appropriate and the connector and method of manufacture thereof associated with such modifications are also included within the technical concept of the present invention.

DESCRIPTION OF THE REFERENCE NUMERALS

1 Connector
2 Housing

3 Housing main body
3A First section
3B Second section
5A, 5B, 5C, 5D Terminal holding portions
14 Spacer
21A, 21B, 21C, 21D Coaxial terminals
22 Internal terminal
26 External terminal
27 Conductor mounting portion
31 Terminal connecting portion
37A, 37B, 37C, 37D Shielding members
38 Base portion
45 Extension portion
46 Protrusion
51 Coupling member
52 Main body portion
53A, 53B, 53C, 53D Contact pieces
55 Securing portion
63A, 63B, 63C, 63D Curved portions
65 Securing opening

The invention claimed is:

1. A connector, comprising:

L-shaped coaxial terminals having an internal terminal and an external terminal provided on the outer periphery of the internal terminal, shielding members, formed from an electrically conductive material, that shield the coaxial terminals, and a housing, formed from an insulating material, having provided therein L-shaped terminal holding portions that hold the coaxial terminals and shielding members, wherein:

the external terminal has a conductor mounting portion that extends in a forward-rearward direction and is used to mount an outer conductor of a coaxial cable, and a terminal connecting portion that extends downwardly from the front end side of the conductor mounting portion and is used for connecting to an external terminal of a coaxial terminal in a counterpart connector;

the shielding members cover a section in the external terminal extending from a bottom face of the front end portion of the conductor mounting portion to the rear face of the upper end portion of the terminal connecting portion and, additionally, electrically connect the conductor mounting portion to the terminal connecting portion, and form an electrical path in the external terminal that passes through an area extending from below the front end portion of the conductor mounting portion to the rear of the upper end portion of the terminal connecting portion.

2. The connector according to claim 1, comprising:

four coaxial terminals, four shielding members that respectively shield the four coaxial terminals, and a coupling member, formed from an electrically conductive material, that respectively electrically connects the four shielding members, wherein:

the housing has a first section extending in a forward-rearward direction and a second section extending downwardly from the front end side of the first section;

in the housing, there are provided four terminal holding portions that respectively hold the four coaxial terminals and the four shielding members;

in the housing, the four terminal holding portions are respectively disposed in a section extending from the left lower side of the first section to the left rear side of the second section, a section extending from the right lower side of the first section to the right rear side of the second section, a section extending from the left upper side of the first section to the left front side of the second section, and a section extending from the right upper side of the first section to the right front side of the second section;

the four shielding members are respectively disposed in the curved portions of the four terminal holding portions;

the coupling member is disposed in an area surrounded by the four shielding members respectively disposed in the curved portions of the four terminal holding portions; and the coupling member has a main body portion and four contact pieces that respectively extend from the main body portion to the four shielding members to be respectively brought in contact with the four shielding members.

3. The connector according to claim 2, wherein the main body portion has a securing portion used to secure the coupling member to the housing, a section of each shielding member is sandwiched between the contact pieces and the housing, and the coupling member is secured to the housing by the securing portion, as a result of which the shielding members are supported by the housing via the contact pieces.

4. The connector according to claim 1, wherein the shielding members comprise:

a base portion that is disposed in an area in the external terminal extending from below the front end portion of the conductor mounting portion to the rear of the upper end portion of the terminal connecting portion and that covers a section in the external terminal extending from the bottom face of the front end portion of the conductor mounting portion to the rear face of the upper end portion of the terminal connecting portion, and extension portions that extend from the base portion to the front of the terminal connecting portion and apply pressure to the front face of the terminal connecting portion to thereby bring the rear face of the upper end portion of the terminal connecting portion in contact with the base portion.

5. A method of connector manufacture which is a method of manufacture of the connector according to claim 1, wherein the method comprises the steps of:

disposing the shielding members in the curved portions of the terminal holding portions;

and disposing the coaxial terminals inside the terminal holding portions where the shielding members are disposed.

6. A method of connector manufacture which is a method of manufacture of the connector according to claim 2, wherein the method comprises the steps of:

disposing the four shielding members respectively in the curved portions of the four terminal holding portions in the housing;

in the housing, disposing the coupling member in an area surrounded by the four shielding members respectively disposed in the curved portions of the four terminal holding portions and electrically connecting the four shielding members by bringing the four contact pieces respectively in contact with the four shielding members; and disposing the four coaxial terminals respectively inside the four terminal holding portions where the four shielding members electrically connected by the coupling member are disposed.

* * * * *